United States Patent [19]

Stroze et al.

[11] Patent Number: 4,875,403

[45] Date of Patent: Oct. 24, 1989

[54] VARIABLE DISPLACEMENT PORT PLATE

[75] Inventors: Mark S. Stroze; Richard W. Reynolds, both of Rockford, Ill.

[73] Assignee: Sundstrand Corporation, Rockford, Ill.

[21] Appl. No.: 259,322

[22] Filed: Oct. 18, 1988

[51] Int. Cl.[4] ..... F04B 1/30

[52] U.S. Cl. ..... 91/482

[58] Field of Search ..... 91/482, 484, 483, 499

[56] References Cited

U.S. PATENT DOCUMENTS

| | | | |
|---|---|---|---|
| 784,177 | 3/1905 | Probst | 91/482 X |
| 2,546,583 | 3/1951 | Born | 91/482 |
| 2,696,810 | 1/1961 | Dudley | 251/362 |
| 2,979,037 | 4/1961 | Budzich | 91/482 X |
| 3,011,453 | 12/1961 | Budzich | 91/485 |
| 3,206,218 | 9/1965 | Potter et al. | 91/482 X |
| 3,362,342 | 1/1968 | Flint et al. | 91/482 |
| 4,644,850 | 2/1987 | Kanamaru et al. | 91/499 X |

*Primary Examiner*—Leonard E. Smith

*Attorney, Agent, or Firm*—Antonelli, Terry & Wands

[57] ABSTRACT

An improved hydraulic apparatus is disclosed which may function as either a hydraulic pump or hydraulic motor. A port plate (18) is provided with a high pressure arcuate prot (82) which permits the full range of rotation of the port plate to be used in linearly adjusting the rate of fluid flow into the cylinders (22) of the cylinder block (20). The invention provides a maximum range of adjustability of the volume of fluid flow passing through the cylinders.

14 Claims, 3 Drawing Sheets

VARIABLE DISPLACEMENT PORT PLATE

DESCRIPTION

1. Technical Field

The present invention relates to hydraulic pumps and hydraulic motors having a rotating port plate which is rotatable from a reference position in either of two directions through a maximum of 90° to vary the torque or fluid output from a minimum to a maximum in either direction.

2. Background Art

FIG. 1 illustrates a generalized sectional view of a prior art axial piston hydraulic machine which may function as a pump or hydraulic motor. Hydraulic machines of this type and also with a bent axis are well known and have been utilized in diverse applications. Only the general construction of the axial piston design will be described hereinbelow but it should be understood that the invention is also applicable to the bent axis design. The drive shaft 12 is supported by a pair of bearings which are comprised of a front bearing 14 and a rear bearing 16. The front bearing 14 is mounted in a variable displacement port plate 18. As is known in the art, the variable displacement port plate 18 in a hydraulic apparatus, is rotatable through an angle less than plus or minus 90° of rotation from a reference position to either vary the output torque when the apparatus functions as a motor or volume of hydraulic fluid displaced by the cylinders of a cylinder block from a minimum to a maximum for rotations of the port plate in either direction. The limitation of the rotation of the port plate less than 90° is a consequence of the geometry of the port plate 18 discussed with reference to FIG. 2 below. This limits the torque or displacement capabilities of the hydraulic machine. A cylinder block 20 containing a plurality of cylinders 22 rotates in response to either input torque applied to the drive shaft 12 when the hydraulic apparatus is functioning as a pump or in response to high pressure hydraulic fluid applied to a supply feed port 28 within a fixed housing 29 to cause rotation. Each of the pistons reciprocates in a bore in the cylinder block 20 to sweep out a variable volume of hydraulic fluid which is a function of the rotary position of the port plate 18. Fluid exiting the cylinders passes through a return fixed port 30 within the housing 29. A piston shoe 24 rides on a bearing plate 26. A low pressure arcuate port illustrated in FIG. 2 within the port plate functions to conduct low pressure hydraulic fluid which is swept into the cylinders 22 in response to rotation of the cylinder block 20 and a high pressure arcuate port illustrated in FIG. 2 functions to conduct high pressure hydraulic fluid passing through the cylinders 22 in a manner well known in the art. A layout of the low pressure and high pressure arcuate ports is described below with reference to FIG. 2. A fixed angle plate 32, which also may be referred to as a swash plate, is fixed relative to the cylinder block to maintain a constant displacement of the cylinders.

FIG. 2 illustrates a top plan view off a port plate 18 of FIG. 1 at the interface 31 with housing 29. The port plate 18 has a low pressure arcuate port 36 and a high pressure arcuate port 38. Each of the arcuate ports 36 and 38 are symmetrically disposed around center 40 and subtend equal angles as measured from the center. It should be understood that the drive shaft 12 and bearing 14 have been omitted to simplify the drawings. Solid areas 42 separate the high pressure and low pressure ports 36 and 38. The length of the arc contained in the areas 42 is required to be larger than the diameter of the cylinders 22 of the rotating cylinder block 20 in order to avoid cross coupling between the high and low pressure ports during rotation of the cylinder block. Furthermore, in hydraulic apparatus using extremely high pressures, the arcuate length of the areas 42 between the low pressure and high pressure arcuate ports 36 and 38 is further lengthened to provide precompression when going from low to high pressure and expansion when going from high to low pressure. It should be understood that the arcuate low and high pressure ports 36 and 38 extend through the thickness of the port plate 18 and meet with the feed ports 28 and 30 as illustrated in phantom in housing 29. The feed ports 28 and 30 in the housing 29 permit coupling of hydraulic fluid into or out of the fixed plate for an angle equal to the arc subtended by the high and low pressure ports 36 and 38 extending out of the cylinder block 20. The angular adjustment of the port plate in the prior art is less than ±90° measured from the "reference position" as illustrated in FIG. 2 and is identified therein by "adjustable angle". The adjustability of the amount of fluid flow in the high and low pressure ports is limited to the angle subtended by the high and low pressure ports as described in FIG. 2. However, as described above, the full range of adjustability in output torque or pumped hydraulic fluid produced by rotation of the port plate 18 is not used. The feed ports 28 and 30 are partially covered at large displacements thereby causing throttling of return and supply flows which ultimately shuts off flow when the hydraulic apparatus should be at full displacement. Accordingly, the prior art does not permit adjustment of the displacement of hydraulic fluid throughout the full 90° of rotation through which the geometry of the angle plate permits adjustment.

U.S. Pat. Nos. 2,546,583, 2,969,810, 2,979,037, 3,011,453 and 4,644,850 disclose prior art hydraulic or fluid machines.

DISCLOSURE OF INVENTION

The present invention provides a hydraulic apparatus, which may be either a pump or a hydraulic motor, having a displacement which is adjusted by rotation of a port plate in first and second directions throughout an angle up to a maximum angle with the displacement being continuously adjustable throughout the range of rotation from a reference position in either direction up to the maximum angle. The present invention does not have its supply or return ports covered by the area 42 of FIG. 2. With the invention the linear range of adjustment of displacement of hydraulic fluid either inputted when the present invention is utilized as a hydraulic motor or outputted when the present invention is utilized as a pump is spread over the full range of adjustment which is permissible and is equal to plus or minus 90°.

A hydraulic apparatus in accordance with the invention includes a rotatable cylinder block having a plurality of cylinders with each cylinder containing a piston which reciprocates in the cylinder to define a volume which is filled with hydraulic fluid as the piston reciprocates in conjunction with rotation of the block; a port plate having a body with a first surface which rotatably engages the cylinder block and a second surface which rotatably engages a fixed surface, the first surface having a high pressure arcuate port and a low pressure arcuate port with each port being radially disposed with respect to a center of the body and the ports being separated by a pair of arcs, the ports intercepting openings of the cylinders as the cylinder block rotates, the body being rotatable in first and second directions to vary an effective volume of hydraulic fluid taken into the cylinders from a minimum through a maximum for rotation in either direction with a maximum angle subtended by rotation in either direction being greater than an angle subtended by the high pressure arcuate port which preferably is at least 90°; and a first passage extending through the port plate from the high pressure arcuate port to a second arcuate port in the second surface which faces the fixed surface and which subtends an angle defined with respect to the center of the body at least as large as the maximum angle and is in fluid communication with a port in the fixed surface throughout an angle as least as large as the maximum angle. The effective volume is the amount of hydraulic fluid utilized during the power stroke. The second arcuate port has a raised wall extending away from the second surface which totally encircles and defines the second port with respect to the second surface which receives the passage. The invention may be implemented in either a hydraulic motor or pump. The maximum angle is 90°; and the angle subtended by the second arcuate port is greater than 90°. Furthermore, a second passage extends form the low pressure arcuate port through the body to a discharge port with the discharge port being preferably located in the center portion of the body.

In a hydraulic apparatus having a rotatable port plate which is rotatable to vary a volume of hydraulic fluid taken into cylinders located in a rotatable cylinder block which is rotated in first and second directions up to a maximum angle of ±90° from a reference position to vary the volume from a minimum to a maximum in either direction with the port plate having a low pressure arcuate port and a high pressure arcuate port which each subtend an angle measured from a center of the port plate less than 90° and with the port plates being separated along a pair of arcs measured from the center of the port plate with each of the pair of arcs being equal to or greater than a diameter of cylinders of the port plate, an improvement in accordance with the invention includes a passage extending from the high pressure arcuate port through a body of the port plate to a second high pressure arcuate port subtending an angle of at least 90°, the second high pressure arcuate port being in fluid communication with a port disposed in a fixed surface throughout at least ±90° of rotation of the body of the port plate to permit adjustment of volume of hydraulic fluid taken into between a minimum and a maximum throughout 90° of rotation of the port plate in either direction. Furthermore, the apparatus may function as either a pump or hydraulic motor. A second passage extends from the low pressure arcuate port through the body of the port plate to a discharge port which is preferably located in a center portion of the body. The second arcuate port has a raised wall extending away from the second surface which totally encircles and defines the second arcuate port with respect to the second surface which receives the passage.

BEST MODE FOR CARRYING OUT THE INVENTION

Figure 1:
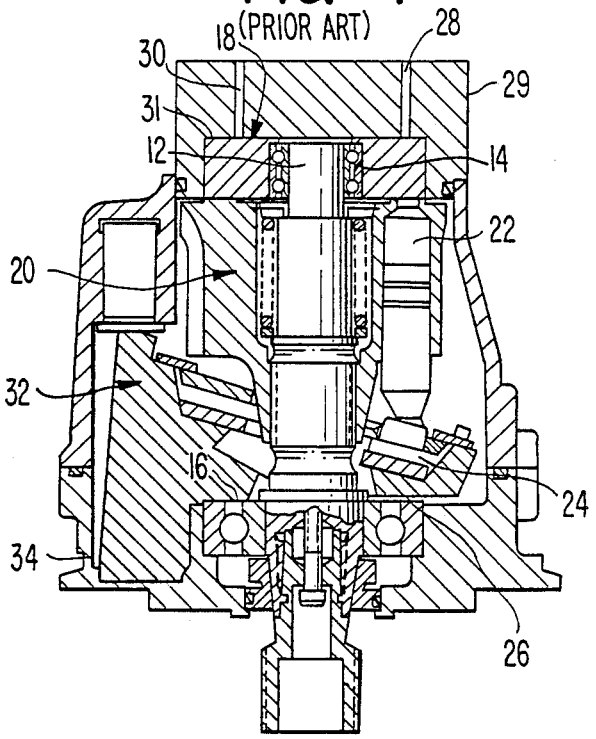
FIG. 1 (PRIOR ART)
FIG. 1 is a sectional view of a prior art hydraulic apparatus which may function as either a pump or a hydraulic motor.
Figure 2:
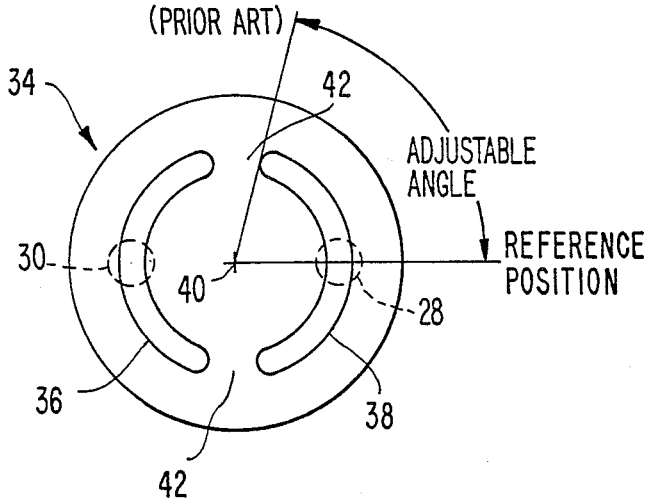
FIG. 2 (PRIOR ART)
FIG. 2 is a top plan view of a port plate of the prior art hydraulic apparatus of FIG. 1.
Figure 3:
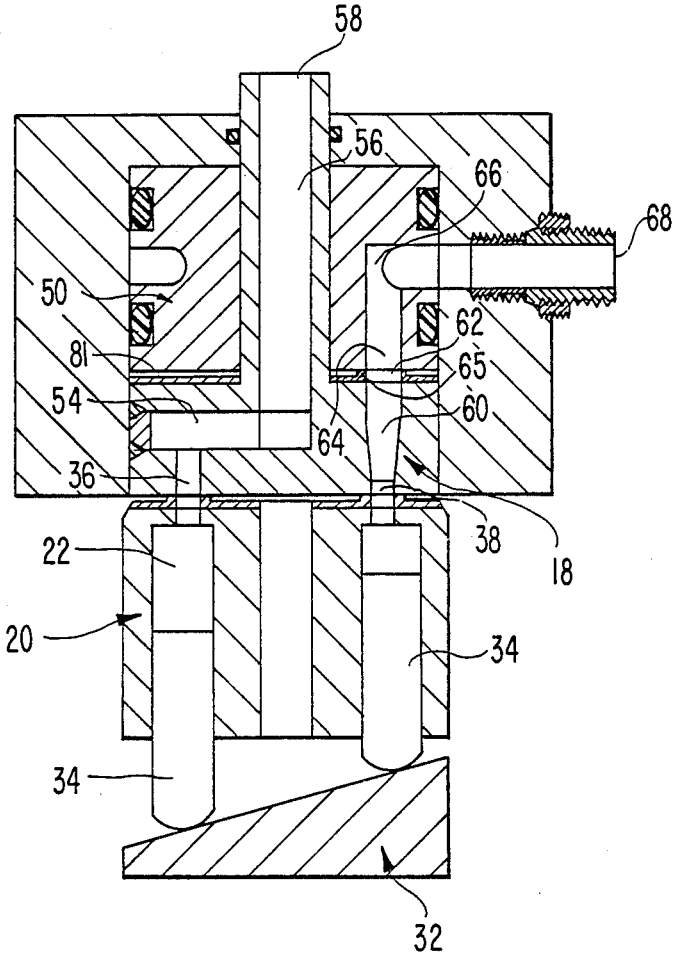
FIG. 3 is an elevational view of the present invention.

FIG. 3 illustrates an elevational view of a hydraulic apparatus in accordance with the present invention which may function as either a hydraulic pump or hydraulic motor. Conventional structures as discussed above with FIG. 1 have been omitted to simplify illustration. It should be further understood that the present invention is useful in any configuration of hydraulic apparatus which may function as either a hydraulic motor or hydraulic pump in which the volume of fluid taken into a cylinder block is varied as a function of rotation of the port plate in first and second directions from a reference position. The present invention permits the linear variation of the effective volume of hydraulic fluid from a reference position taken into cylinders of a rotating cylinder block throughout the entire range of adjustment which is available as a consequence of the geometry of a port plate. The effective volume is the amount of hydraulic fluid utilized during the power stroke. Like parts in FIGS. 1–3 are identified by like reference numerals. The port plate 18 is adjustable throughout a maximum possible rotational range of 90° in first and second directions measured from a reference position (FIG. 6) to vary the volume of pumped hydraulic fluid or torque which is outputted depending upon whether the apparatus is operated as a pump or hydraulic motor. The rotatable port plate 18 is in surface contact with a fixed housing 50. The arcuate low pressure port 36 opens into a passage 54 which extends into the center of the port plate and then extends axially upward through passage 56 to open at a discharge port 58. Similarly, the high pressure arcuate port 38 opens into a passage 60 which opens into a second arcuate port 62 described below with reference to FIG. 6. A corresponding circular port 64 within a passage 66 of fixed housing 50 opens into a high pressure input port 68. As will be described in more detail below in FIG. 6, the second arcuate port 62 subtends an angle greater than 90° to permit a linear adjustment in the rate of fluid flow into the passage 64 throughout the entire ±90° of rotation available in adjustment of the port plate. A raised fluid tight seal 65 is provided between the ports 62 and 64 and is discussed below with reference to FIG. 6.

Figure 4:
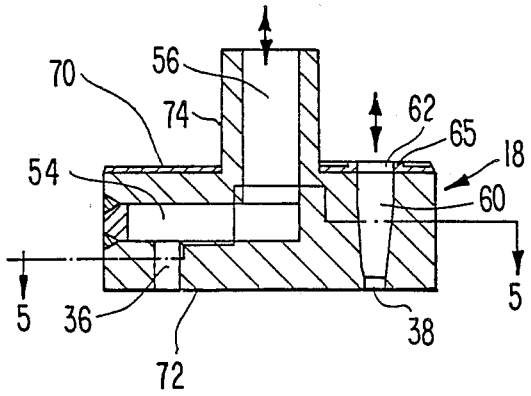
FIG. 4 is a sectional view of the port plate of the present invention.

FIG. 4 illustrates a sectional view of rotatable port plate 18 as described above. Like reference numerals identify like parts in FIGS. 1–4. Surfaces 70 and 72 rotate respectively with respect to the fixed housing 50 and the cylinder block 20. It should be noted that the vertically extending passage 56 has been truncated to simplify the illustration. Furthermore, it should be noted that surface 74 rotates with respect to the fixed housing 50.

Figure 5:
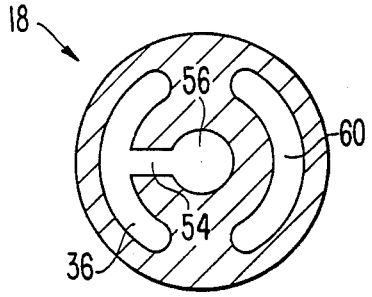
FIG. 5 is a sectional view of the port plate of FIG. 4.

FIG. 5 illustrates a sectional view of the port plate 18 of FIG. 4. Like parts in FIGS. 3–5 are identified with like reference numerals. It should be noted that the high pressure passage 60 and the passage 36 have an arcuate shape like that illustrated in the prior art of FIG. 2.

Figure 6:
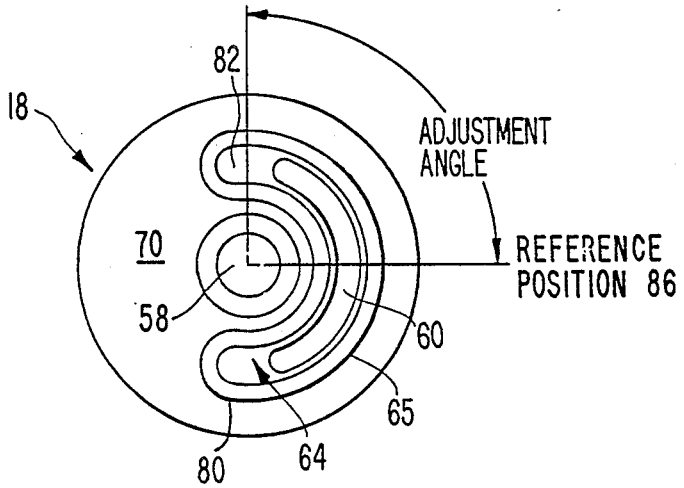
FIG. 6 is a top plan view of the port plate of FIG. 4.

FIG. 6 illustrates a top view of the port plate 18 at the interface 81 with the fixed housing 50 of FIG. 4. Like parts are identified with like reference numerals in FIGS. 3–6. A raised wall 65 totally encircles the area 82 and extends upward from surface 70 by a dimension such as 20–30 thousandths of an inch to permit hydraulic fluid to flow downward from port 64 into the region 82 and then flow inward to the high pressure passage 60 to the arcuate port 38 which communicates with the cylinder. As illustrated, the raised wall 65 defining area 82 permits an "adjustment angle" of a ±90° from the "reference position" 86. Therefore, when the port plate 18 is rotated through an angle greater than the adjustment angle illustrated in FIG. 2, the volume of fluid applied to drive the hydraulic apparatus as a motor or outputted when the apparatus is operated as a motor is linearly adjustable through a full 90° of the "adjustment angle" of FIG. 6.

We claim:

1. A hydraulic apparatus comprising:

(a) a rotatable cylinder block having a plurality of cylinders with each cylinder containing a piston which reciprocates in the cylinder to define a volume which is filled with hydraulic fluid as the piston reciprocates in conjunction with rotation of the block;

(b) a port plate having a body with a first surface which rotatably engages the cylinder block and a second surface which rotatably engages a fixed surface, the first surface having a high pressure arcuate port and a low pressure arcuate port with each port being radially disposed with respect to a center of the body and the ports being separated by a pair of arcs, the ports intercepting openings of the cylinders as the cylinder block rotates, the body being rotatable in first and second directions to vary a volume of hydraulic fluid taken into the cylinders from a minimum through a maximum for rotation in either direction with a maximum angle subtended by rotation in either direction being greater than an angle subtended by the high pressure arcuate port; and (c) a first passage extending through the port plate from the high pressure arcuate port to a second arcuate port in the second surface which faces the fixed surface and which subtends an angle defined with respect to the center of the body at least as large as the maximum angle and is in fluid communication with a port in the fixed surface of the port plate throughout an angle as least as large as the maximum angle.

2. A hydraulic apparatus in accordance with claim 1 wherein the second arcuate port comprises:

a raised wall extending away from the second surface which totally encircles and defines the second port with respect to the second surface which receives the passage.

3. A hydraulic apparatus in accordance with claim 1 wherein:

the apparatus is a hydraulic motor.

4. A hydraulic apparatus in accordance with claim 1 wherein:

the apparatus is a hydraulic pump.

5. A hydraulic apparatus in accordance with claim 1 wherein:

(a) the maximum angle is 90°;

(b) each of the low pressure and high pressure ports subtend an angle which is less than 90°; and

(c) the angle subtended by the second arcuate port is greater than the angle subtended by high pressure port.

6. A hydraulic apparatus in accordance with claim 5 wherein:

the angle subtended by the second arcuate port is greater than ±90°.

7. A hydraulic apparatus in accordance with claim 1 further comprising:

a second passage extending from the low pressure arcuate port through the body to a discharge port.

8. A hydraulic apparatus in accordance with claim 7 wherein:

the discharge port is in a center portion of the body.

9. In a hydraulic apparatus having a port plate which is rotatable to vary a volume of hydraulic fluid taken into cylinders located in a rotatable cylinder block which is rotated in first and second directions up to a maximum angle of ±90° from a reference position to vary the volume from a minimum to a maximum with the port plate having a lower pressure arcuate port and a high pressure arcuate port which each subtend an angle measured form a center of the port plate less than 90° and with the ports being separated along a pair of arcs measured from the center of the port plate with each arc being equal to or greater than a diameter of cylinders of the port plate, the improvement comprising:

a passage extending from the high pressure arcuate port through a body of the port plate into a second high pressure arcuate port subtending an angle of at least 90°, the second high pressure arcuate port being in fluid communication with a port disposed in a fixed surface through at least ±90° of rotation of the body of the port plate to permit adjustment of hydraulic fluid between a minimum and a maximum throughout 90° of rotation of the port plate in either direction.

10. A hydraulic apparatus in accordance with claim 9 wherein:

the apparatus is a hydraulic pump.

11. A hydraulic apparatus in accordance with claim 10 wherein:

the apparatus is a hydraulic motor.

12. A hydraulic apparatus in accordance with claim 9 further comprising:

a second passage extending from the low pressure arcuate port through the body to a discharge port.

13. A hydraulic apparatus in accordance with claim 12 wherein:

the discharge port is in a center portion of the body.

14. A hydraulic apparatus in accordance with claim 13 wherein the second arcuate port comprises:

a raised wall extending upward from the second surface which totally encircles and defines the second arcuate port with respect to the second surface which receives the passage.

* * * * *